US010537934B1

(12) United States Patent
Thorpe

(10) Patent No.: US 10,537,934 B1
(45) Date of Patent: Jan. 21, 2020

(54) GROMMET DIE DEVICE AND SYSTEM

(71) Applicant: Ricky Thorpe, Davie, FL (US)

(72) Inventor: Ricky Thorpe, Davie, FL (US)

( * ) Notice: Subject to any disclaimer, the term of this patent is extended or adjusted under 35 U.S.C. 154(b) by 0 days.

(21) Appl. No.: 16/232,152

(22) Filed: Dec. 26, 2018

(51) Int. Cl.
*B21D 53/16* (2006.01)
*B21K 25/00* (2006.01)

(52) U.S. Cl.
CPC ..... *B21K 25/00* (2013.01); *B21D 53/16* (2013.01)

(58) Field of Classification Search
CPC ... B21K 25/00; Y10T 29/13; Y10T 29/49897; Y10T 29/49899; Y10T 29/49948; Y10T 29/49954; B25B 27/0028; B25B 27/0092; B25B 27/28
See application file for complete search history.

(56) References Cited

U.S. PATENT DOCUMENTS 5,422,202 A * 6/1995 Spiegelberg ..... H01M 2/305 429/179
5,814,421 A * 9/1998 Spiegelberg ..... B21J 9/025 429/178

* cited by examiner

*Primary Examiner* — Jason L Vaughan
*Assistant Examiner* — Amanda Kreiling
(74) *Attorney, Agent, or Firm* — Johnson & Martin, P.A.; James David Johnson

(57) ABSTRACT

A die for attaching a washer to a grommet to create a grommet-washer assembly for use in a system for opening and closing window treatments is described. The die includes a top die and a bottom die. The grommet is placed onto a top surface of the bottom die, and the washer is placed on top of the grommet. When the press is actuated, the top and bottom dies press together to attach the washer to the grommet. A system and methods are also described that features the die and a press on which the top die and the bottom die are installed so that the combined grommet-washer assembly is creatable when the press is actuated to attach the washer to the grommet. The grommet-washer assembly does not rotate when used with a system for opening and closing window treatments.

21 Claims, 5 Drawing Sheets

GROMMET DIE DEVICE AND SYSTEM

FIELD OF THE INVENTION

The invention relates to a die for attaching a washer to a grommet. More particularly, the invention relates to a die for attaching a washer to a grommet to create a combined grommet-washer assembly such as those for use in systems for opening and closing window treatments.

BACKGROUND

Various devices exist for opening and closing window treatments such as curtains and vertical blinds. Grommets are used in some types of window treatment closure devices. Such grommets may rotate when installed on a device for opening and closing window treatments. Such rotation may interference with the normal operation of the device for opening and closing window treatments, and therefore, is undesirable.

A need exists for a grommet that does not rotate when in use as part of a device or system for opening and closing window treatments. A need also exists for devices, systems, and methods for creating grommets that do not rotate when in use as part of a device or system for opening and closing window treatments.

SUMMARY

The invention relates to a die for attaching a washer to a grommet to create a grommet-washer assembly for use in a system for opening and closing window treatments is described. Such systems for opening and closing window treatments include, for example, systems as described in U.S. Pat. No. 9,730,541, which is incorporated herein by reference in its entirety. A window treatment device of an opening and closing system can include a main body, an elongated rod, a secondary body, a curtain rod, and a grommet. The grommet is used to attach the window treatment such as, for example, a curtain, a drape, or a vertical blind. The elongated rod can be locatable at least partially within the main body. The secondary body can be slidably positionable about the elongated rod. The main body can be at least partially insertable into the curtain rod. The grommet can be attachable to the main body. The main body may include an upper main body receiver slot to receive the grommet. The grommet may include a grommet tab insertable into an upper main body retainer clip. The upper main body retainer clip may be insertable into the upper main body receiver slot to attach the grommet. The curtain rod may include a curtain rod opening extending substantially between a curtain rod front end and a curtain rod rear end of the curtain rod. At least part of the grommet can be at least partially passable through the curtain rod opening. The main body that is removably attached to the grommet via insertion of the upper main body retainer clip into the upper main body receiver slot can be at least partially passable through the curtain rod opening with the grommet.

To prevent the grommet from rotating when installed in such a window treatment opening and closing system, a washer can be attached to the grommet. The washer can include teeth that clamp down on the grommet when the washer is attached. The washer is attached to the grommet using the die by installing the die on a die press.

The die device includes a top die and a bottom die. The grommet is placed onto a top surface of the bottom die, and the washer is placed on top of the grommet. When the press is actuated, the top and bottom dies press together to attach the washer to the grommet. A system and methods are also described that features the die and a press on which the top die and the bottom die are installed so that the combined grommet-washer assembly is creatable when the press is actuated to attach the washer to the grommet. The invention also relates to a die device as described herein and a press to which it is attachable for attaching a washer to a grommet.

The devices, systems, and methods described herein provide an advantage in that they are useful for creating a combined grommet-washer assembly that does not rotate when used as a part of a device or system for opening and closing window treatments.

Accordingly, the invention features a die for attaching a washer to a grommet. The die includes a top die and a bottom die. The top die features a shaping element for pressing a washer onto a grommet. The bottom die is for receiving the grommet for attachment of the washer thereto and includes a stabilization element and a central annular ridge surrounded by a planar surface. The central annular ridge includes a converging outer side wall, wherein the side wall's diameter at a base of the side wall is greater than the side wall's diameter at a top of the side wall. The central annular ridge defines a bore centrally located in a top surface of the bottom die, and the shaping element of the top die is receivable into the bore of the bottom die.

In another aspect, the invention can feature the top die further including a stabilization element.

In another aspect, the invention can feature the stabilization element of the top die including a threaded pin that connects to a press to maintain the top die in a fixed position when the press is in use.

In another aspect, the invention can feature the shaping element of the top die being round.

In another aspect, the invention can feature the shaping element of the top die including a top wall and a side wall, and wherein the shaping element further includes a cut-out that extends through the top wall and the side wall and terminates at the planar surface of the top die.

In another aspect, the invention can feature the stabilization element of the bottom die including at least two pins that connect to a press to maintain the bottom die in a fixed position when the press is in use.

In another aspect, the invention can feature a side surface of the top die including a first sight line and a side surface of the bottom die including a second sight line. The sight lines of the top and bottom dies are positionable to align the top and bottom dies when they are connected to the press.

In another aspect, the invention can feature the side wall of the bottom die being flat or concavely curved as it converges from the larger diameter of the side wall's base to the small diameter of the side wall's top.

The invention also features a die for attaching a washer to a grommet. The die includes a top die and a bottom die. The top die is for pressing a washer onto a grommet. The top die features a stabilization element and a round shaping element attached on a planar surface of the top die, wherein the round shaping element includes a top wall and a side wall. The round shaping element further includes a cut-out that extends through the top wall and the side wall and terminates at the planar surface of the top die. The bottom die is for receiving the grommet for attachment of the washer thereto, and includes a bore into which the round shaping element of the top die is receivable.

In another aspect, the invention can feature the bottom die further including a stabilization element.

In another aspect, the invention can feature the stabilization element of the bottom die including at least two pins that connect to a press to maintain the bottom die in a fixed position when the press is in use.

In another aspect, the invention can feature the bottom die further including a central annular ridge surrounded by a planar surface.

In another aspect, the invention can feature the central annular ridge including a converging outer side wall, wherein the side wall's diameter at a base of the side wall is greater than the side wall's diameter at a top of the side wall. The central annular ridge defines the bore centrally located in a top surface of the bottom die.

In another aspect, the invention can feature the stabilization element of the top die including a threaded pin that connects to a press to maintain the top die in a fixed position when the press is in use.

In another aspect, the invention can feature a side surface of the top die including a first sight line and a side surface of the bottom die including a second sight line. The sight lines of the top and bottom dies are positionable to align the top and bottom dies when they are connected to the press.

In another aspect, the invention can feature the side wall of the bottom die being flat or concavely curved as it converges from the larger diameter of the side wall's base to the small diameter of the side wall's top.

The invention also features a system for attaching a washer to a grommet, wherein the combined grommet-washer assembly is for use with a system for opening and closing window treatments. The system for attaching the grommet to the washer includes a top die, a bottom die, and a press. The top die is for pressing a washer onto a grommet. The top die includes a stabilization element and a round shaping element attached on a planar surface of the top die. The round shaping element includes a top wall and a side wall, and further includes a cut-out that extends through the top wall and the side wall and terminates at the planar surface of the top die. The bottom die is for receiving the grommet for attachment of the washer thereto. The bottom die includes a stabilization element and a central annular ridge surrounded by a planar surface. The central annular ridge includes a converging outer side wall, wherein the side wall's diameter at a base of the side wall is greater than the side wall's diameter at a top of the side wall. The central annular ridge defines a bore centrally located in a top surface of the top die, and the round shaping element of the top die is receivable into the bore of the bottom die. The top die and the bottom die are installable on the press so that a combined grommet-washer assembly is creatable when the press is actuated to attach the washer to the grommet.

In another aspect, the invention can feature a side surface of the top die including a first sight line and a side surface of the bottom die including a second sight line. The sight lines of the top and bottom dies are positionable to align the top and bottom dies when they are connected to the press.

In another aspect, the invention can feature the side wall of the bottom die being flat or concavely curved as it converges from the larger diameter of the side wall's base to the small diameter of the side wall's top.

In another aspect, the invention can feature the washer including teeth that are pressed into the grommet when the press is actuated.

A method of the invention can be used for attaching a washer to a grommet, wherein the combined grommet-washer assembly is for use with a system for opening and closing window treatments. The method includes the steps of: (a) connecting a top die to a press, wherein the top die is for pressing a washer onto a grommet, and wherein the top die features: (i) a stabilization element; and (ii) a round shaping element attached on a planar surface of the top die, wherein the round shaping element includes a top wall and a side wall, and wherein the round shaping element further includes a cut-out that extends through the top wall and the side wall and terminates at the planar surface of the top die; (b) connecting a bottom die to the press, wherein the bottom die is for receiving the grommet for attachment of the washer thereto, and wherein the bottom die features: (i) a stabilization element; and (ii) a central annular ridge surrounded by a planar surface, wherein the central annular ridge includes a converging outer side wall, wherein the side wall's diameter at a base of the side wall is greater than the side wall's diameter at a top of the side wall, wherein the central annular ridge defines a bore centrally located in a top surface of the top die, and wherein the round shaping element of the top die is receivable into the bore of the bottom die; (c) placing the grommet onto the planar surface of the bottom die and the washer on top of the grommet; and (d) actuating the press to press the top die and the bottom die together thereby attaching the waster to the grommet.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
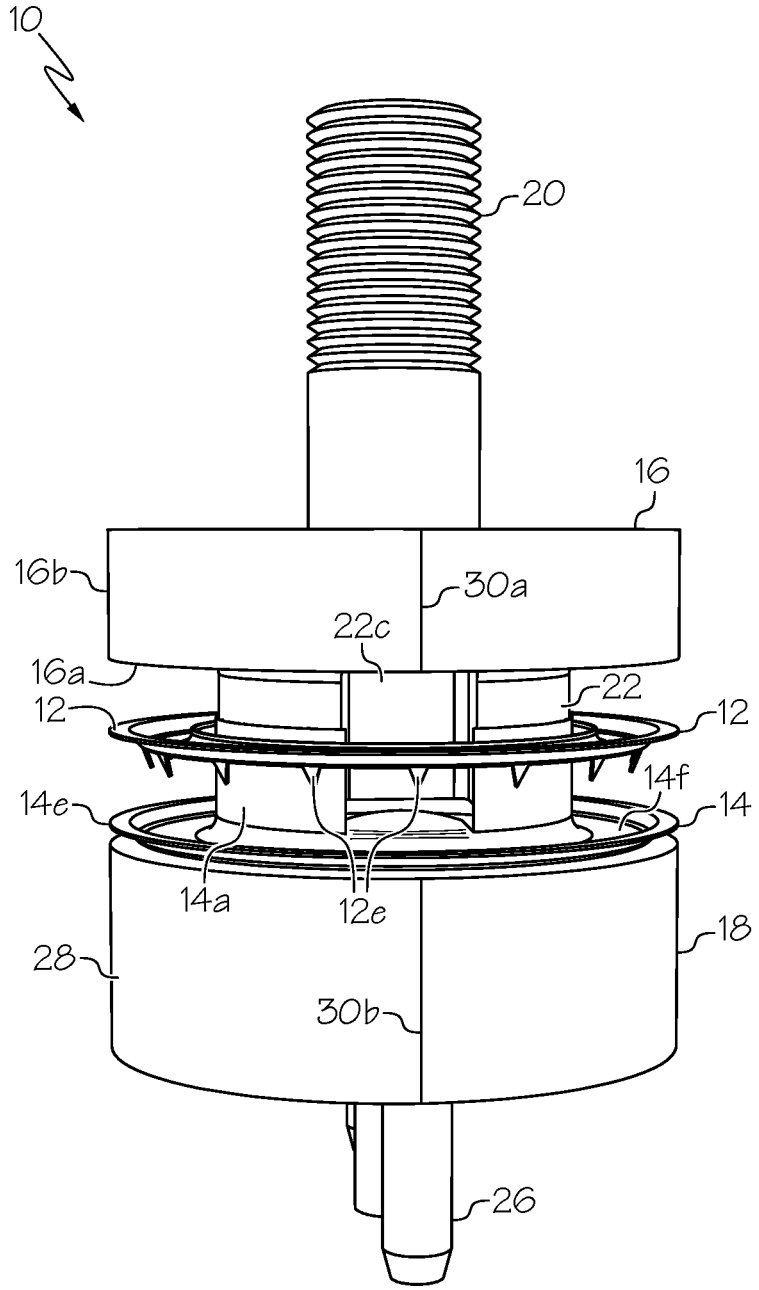
FIG. 1 is a front view of a die (which include a top die and bottom die) that is useful for connecting a washer and a grommet, which once connected may be used as part of a window treatment closure device.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Figure 2:
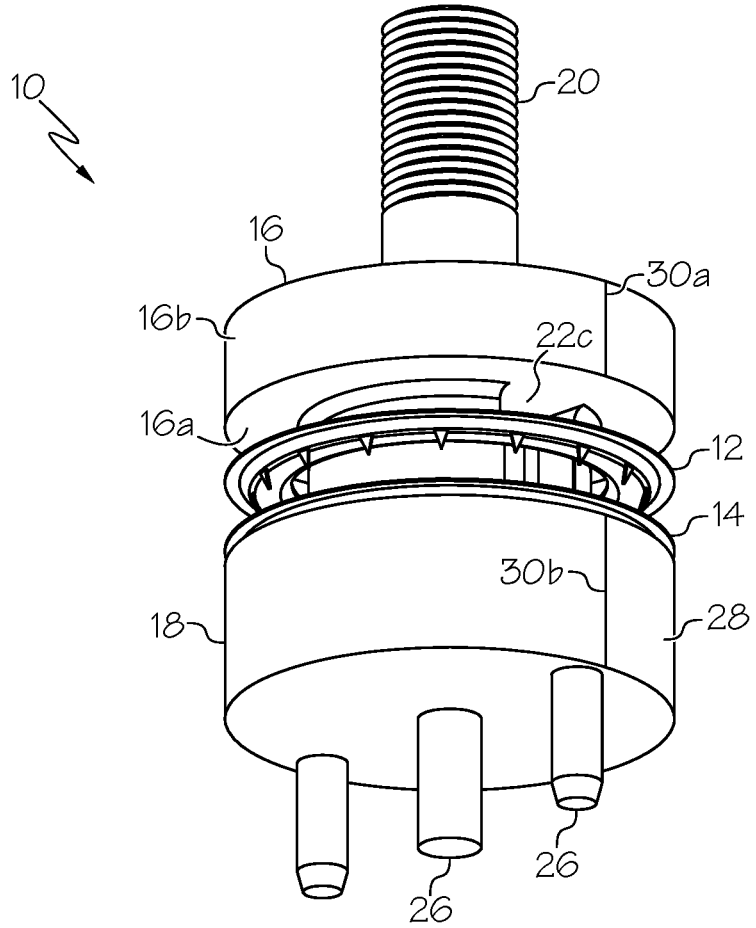
FIG. 2 is a bottom perspective view of the die.
Figure 3A:
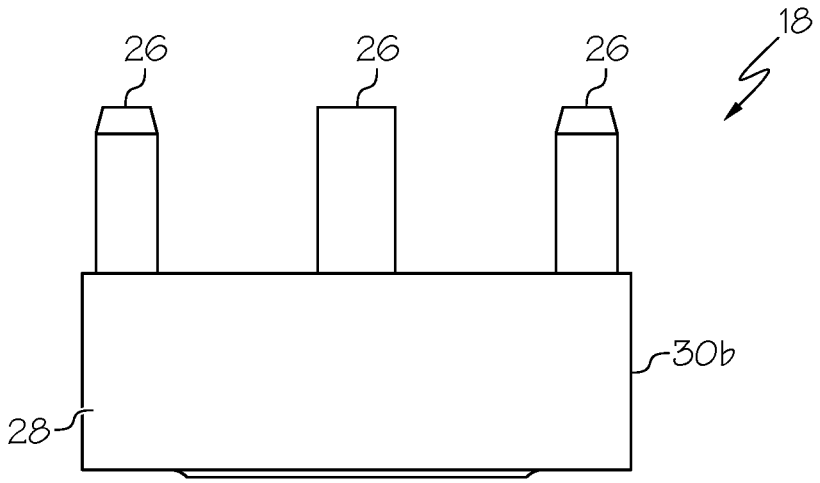
FIG. 3A is a side elevation view of the bottom die.
Figure 3B:
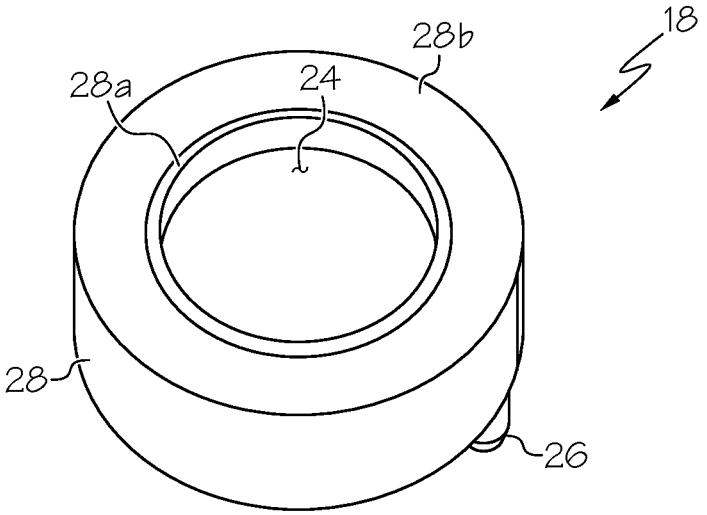
FIG. 3B is a top perspective view of the bottom die.
Figure 3C:
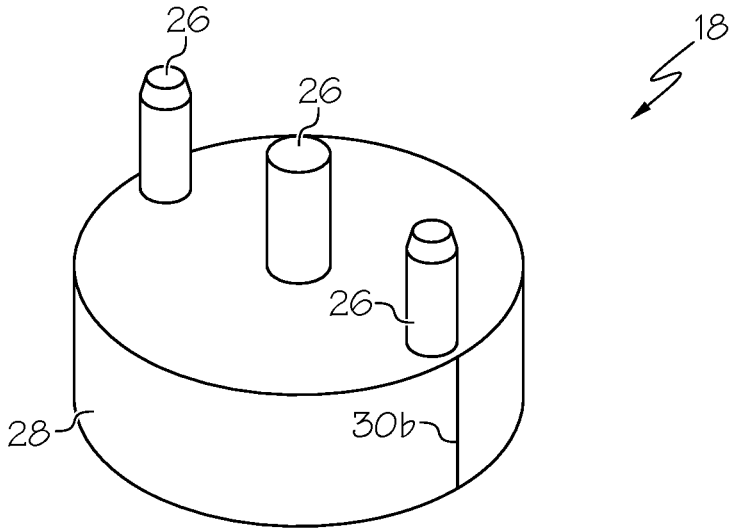
FIG. 3C is a side perspective view of the bottom die.
Figure 4A:
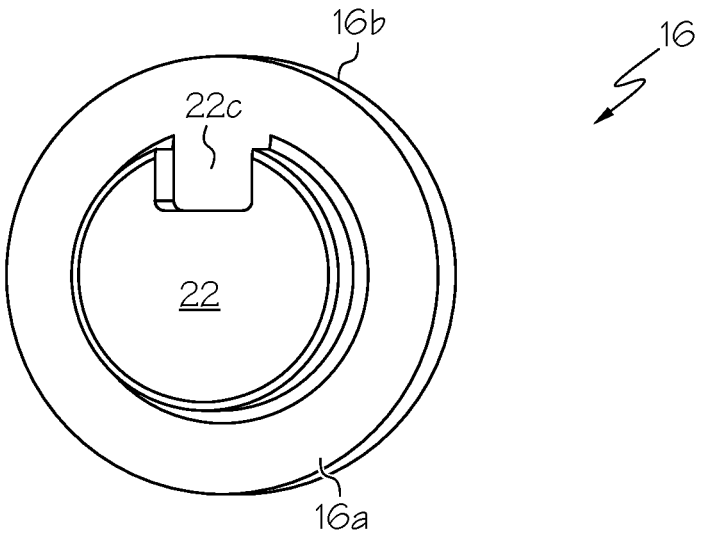
FIG. 4A is a top plan view of the top die.
Figure 4B:
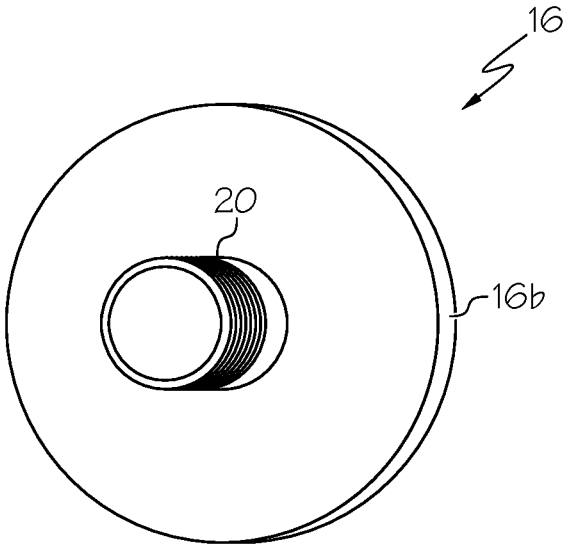
FIG. 4B is a bottom plan view of the top die.
Figure 4C:
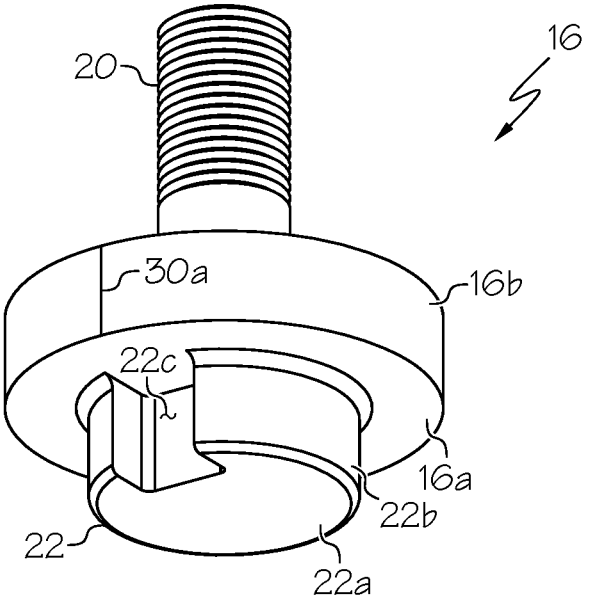
FIG. 4C is a bottom perspective view of the top die.
Figure 5A:
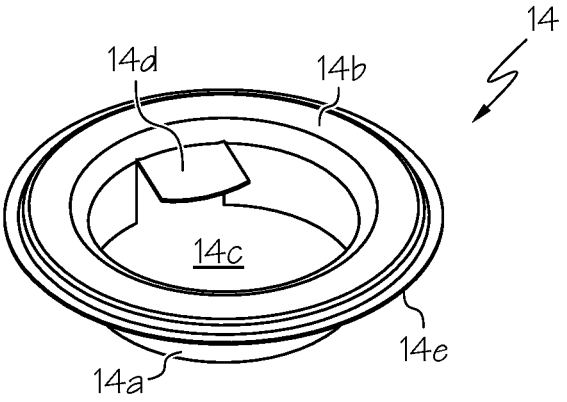
FIG. 5A is a perspective view of a grommet of the type that is pressable using the die in a press.
Figure 5B:
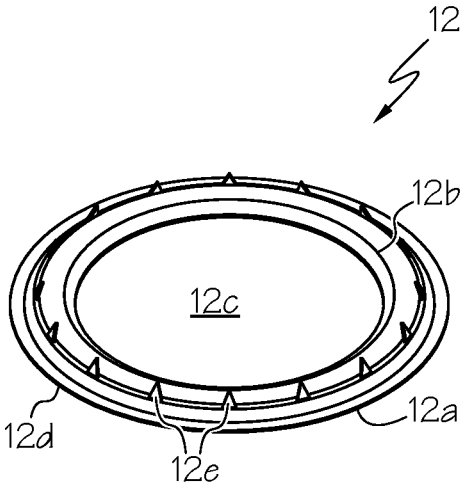
FIG. 5B is a perspective view of a washer of the type that is connectable to the grommet of FIG. 5A using the die in a press.

The invention provides a die device 10 for attaching a washer 12 to a grommet 14. As shown in FIGS. 1 and 2, the die 10 includes a top die 16 and a bottom die 18. The bottom die 18 is shown in FIGS. 3A-3C and the top die 16 is shown in FIGS. 4A-4C. A grommet 14 of the type that is pressable by the die device 10 and system of this invention is shown in FIG. 5A, while one embodiment of a washer 12 of the type that is attachable to the grommet 14 using the die device 10 and system of this invention is shown in FIG. 5B. When the top die 16 and bottom die 18 are installed on a die press (not shown in the drawings), a grommet 14 can be placed on a top surface of the bottom die 18 and a washer 12 can be placed on top of the grommet. When actuated, the die press presses the top die 16 into the bottom die 18 thereby pressing and attaching together the grommet 14 and the washer 14 to create a combined grommet-washer assembly. The grommet-washer assembly is used, as described elsewhere herein, as a part of a device or system for opening and closing window treatments.

The top die 16 is for pressing a washer 12 onto a grommet 14 and is connectable to a top portion of the die press. The top die 16 features a stabilization element 20 and a shaping element 22 attached on a planar surface 16*a* of the top die, wherein the shaping element includes a top wall 22*a* and a side wall 22*b*. The shaping element 22 presses the washer 12 onto the grommet 14 when the die press is actuated to press the top die and bottom die together. The shaping element 22 of the top die 16 can be round or any other suitable shape that corresponds to a bore 24 of the bottom die 18. The round shaping element 22 further includes a cut-out 22*c* that extends through the top wall 22*a* and the side wall 22*b* and terminates at the planar surface 16*a* of the top die 16. The bottom die 18 is for receiving the grommet 14 for attachment of the washer 12 thereto, and as referenced above, includes the bore 24 (i.e., a generally cylindrical cavity) into which the round shaping element 22 of the top die 16 is receivable.

In exemplary embodiments, the stabilization element 20 of the top die 16 includes a threaded pin 20 that connects to the press to maintain the top die in a fixed position when the press is in use.

The bottom die 18 is for receiving the grommet 14 for attachment of the washer 12 thereto and is connectable to a bottom portion of the die press. The bottom die 18 includes a stabilization element 26 and a central annular ridge 28*a* attached generally centrally to a top planar surface 28*b* of a cylindrical element 28. The central annular ridge 28*a* includes a converging outer side wall, wherein the side wall's diameter at a base of the side wall is greater than the side wall's diameter at a top of the side wall. The central annular ridge 28*a* defines the bore 24 centrally located on the top planar surface 28*b* of the bottom die 18, and the shaping element 22 of the top die 16 is receivable into the bore 24 of the bottom die 18.

In exemplary embodiments, the stabilization element 26 of the bottom die 18 includes at least two pins 26 that connect to a press to maintain the bottom die in a fixed position when the press is in use. For example, the stabilization element of the bottom die can include two, three, four, five, six, or more pins. In one exemplary embodiment, the stabilization element 26 of the bottom die 18 includes three pins as shown in FIGS. 2, 3A, and 3C. In another embodiment, the stabilization element 26 of the bottom die 18 can include only a single pin. In still another embodiment, the stabilization element of the bottom die can include a threaded pin that connects to the press to maintain the bottom die in a fixed position when the press is in use.

A side wall (or side surface) of the cylindrical element 28 of the bottom die 18 can be flat or concavely curved as it converges from the larger diameter of the side wall's base to the small diameter of the side wall's top.

In exemplary embodiments, a side wall (or side surface) 16*b* of the top die 16 can include a first sight line 30*a* and the side wall of the bottom die 18 can include a second sight line 30*b*. The sight lines 30*a* and 30*b* of the top and bottom dies 16 and 18 are positionable to align the top and bottom dies when they are connected to the die press.

The invention also features a system for attaching a washer to a grommet, wherein the combined grommet-washer assembly is for use with a system for opening and closing window treatments. The system for attaching the grommet to the washer includes a die press and a die device having a top die a bottom die as described above.

The invention also features a method for attaching a washer to a grommet, wherein the combined grommet-washer assembly is for use with a system for opening and closing window treatments. The method includes the step of connecting a top die to a press. The top die can be one that includes any of the features of a top die as described elsewhere herein. The method also features the step of connecting a bottom die to the press. The bottom die can be one that includes any of the features of a bottom die as described elsewhere herein. Next, the invention includes the step of placing a grommet onto the planar top surface of the bottom die and the washer on top of the grommet as shown in FIGS. 1 and 2. Finally, the method includes the step of actuating the press to press the top die and the bottom die together thereby attaching the waster to the grommet to create the combined grommet-washer assembly, which can be installed on a device and system for opening and closing window treatments.

As shown in FIG. 5A, the invention also includes a grommet 14, to which a washer 12 can be attached, for use in devices and systems for opening and closing window treatments. In exemplary embodiments, the grommet 14 is generally circular in cross-shape, although in other embodiments, the grommet may have a different cross-sectional shape. The grommet 14 features an upper annular wall 14*a* connected to a lower annular base 14*b*. The upper annular wall 14*a* defines a central void 14*c* that extends longitudinally through the grommet 14 at a center axis. In some embodiments, a top portion of the upper annular wall of the grommet can include a lip. The lip can turn outward and away from the central void defined by the upper annular wall. The grommet 14 can include a grommet tab 14*d* that is insertable into an upper main body retainer clip of the main body of a window treatment opening and closing system as described elsewhere herein and in U.S. Pat. No. 9,730,541. The grommet tab 14*d* can be generally planar and rectangular in shape and is formed by two adjacent vertical cuts extending from the top portion or lip of the upper annular wall 14*a* to a top surface of the lower annular base 14*b*. The grommet tab 14*d*, once formed, extends into and toward the center of the central void 14*c* defined by the upper annular wall 14*a* and is generally coplanar with the lower annular base 14*b*.

The lower annular base 14*b* is generally planar and is attached to an outer surface of a bottom portion of the upper annular wall 14*a* generally perpendicularly. In some embodiments, an outer edge of the lower annular base 14*b* may include a lip, rim, flange, or collar 14*e* (each hereafter referred to as a flange for convenience). In other embodiments, the outer edge of the grommet's lower annular base 14*b* does not include a lip, rim, flange, or collar. In exemplary embodiments, the flange 14*e* turns upward slightly in relation to a top surface of the lower annular base 14*b* so that the flange is oriented upward in the same or generally the same direction as the upper annular wall 14*a* and extends away from the lower annular base. In this manner, a shallow annular trough 14*f* is formed between an inner side of the flange 14*e* and the outer wall of the upper annular wall 14*a*, with the top portion of the lower annular base 14*b* forming a bottom of the annular trough 14*f*. The top portion of the lower annular base 14*b* (and thus, also the annular trough 14*f* and the flange 14*e* in embodiments that include a flange) encircle the bottom portion of the upper annular wall 14*a*.

As shown in FIG. 5B, the invention also includes a washer 12 that can be attached to a grommet 14 by the die device and system described elsewhere herein for use in devices and systems for opening and closing window treatments. The washer 12 is generally circular in cross-section shape and includes a top side 12*a* and a bottom side 12*b*. The washer 12 is annular and defines an aperture 12*c* that passes through its central axis. In some embodiments, the washer 12 may include a lip, rim, flange, or collar 12*d* at its outer edge. In other embodiments, the outer edge of the washer does not include a lip, rim, flange, or collar. The top side 12*a* of the washer can be flat or concave, for example, slightly or only shallowly concave. In embodiments in which the top side 12*a* of the washer 12 is concave, the bottom side 12*b* of the washer can be convex, for example, slightly convex. In other embodiments, both the top and bottom sides 12*a* and 12*b* of the washer 12 can be flat.

In exemplary embodiments and as described elsewhere herein, the bottom side 12*b* of the washer 12 can include a plurality of teeth 12*e* protruding out and away from the bottom side 12*b*. The grommet 14 is placed onto the bottom die 18 so that the upper annular wall 14*a* of the grommet is facing upward, and the washer 12 is placed onto the top surface of the grommet so that the bottom side of the washer contacts the top surface of the grommet's lower annular base

14*b*. The teeth 12*e* can be arranged concentrically on the washer's bottom side 12*b* at regular or irregular intervals around the bottom side. When the washer 12 and grommet 14 are pressed together by the die 10 and die press, the teeth 12*e* of the washer clamp down on the grommet to create the combined grommet-washer assembly, which will not rotate when installed in a device or system for opening and closing window treatments thereby improving the functionality of that other system in opening and closing window treatments like curtains, drapes, and vertical blinds.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A die for attaching a washer to a grommet, the die comprising:

a top die comprising a shaping element for pressing a washer onto a grommet; and a bottom die for receiving the grommet for attachment of the washer thereto, the bottom die comprising a stabilization element and a central annular ridge surrounded by a planar surface, wherein the central annular ridge comprises a converging outer side wall, wherein the side wall's diameter at a base of the side wall is greater than the side wall's diameter at a top of the side wall, wherein the central annular ridge defines a bore centrally located in a top surface of the bottom die, and wherein the shaping element of the top die is receivable into the bore of the bottom die.

2. The die of claim 1, wherein the top die further comprises a stabilization element.

3. The die of claim 2, wherein the stabilization element of the top die comprises a threaded pin that connects to a press to maintain the top die in a fixed position when the press is in use.

4. The die of claim 1, wherein the shaping element of the top die is round.

5. The die of claim 4, wherein the shaping element of the top die comprises a top wall and a side wall, and wherein the shaping element further comprises a cut-out that extends through the top wall and the side wall and terminates at the planar surface of the top die.

6. The die of claim 1, wherein the stabilization element of the bottom die comprises at least two pins that connect to a press to maintain the bottom die in a fixed position when the press is in use.

7. The die of claim 1, wherein a side surface of the top die comprises a first sight line and a side surface of the bottom die comprises a second sight line, wherein the sight lines of the top and bottom dies are positionable to align the top and bottom dies when they are connected to the press.

8. The die of claim 1, wherein the side wall of the bottom die is flat or concavely curved as it converges from the larger diameter of the side wall's base to the small diameter of the side wall's top.

9. A die for attaching a washer to a grommet, the die comprising:

a top die for pressing a washer onto a grommet, the top die comprising a stabilization element and a round shaping element attached on a planar surface of the top die, wherein the round shaping element comprises a top wall and a side wall, and wherein the round shaping element further comprises a cut-out that extends through the top wall and the side wall and terminates at the planar surface of the top die; and a bottom die for receiving the grommet for attachment of the washer thereto, the bottom die comprising a bore into which the round shaping element of the top die is receivable.

10. The die of claim 9, wherein the bottom die further comprises a stabilization element.

11. The die of claim 10, wherein the stabilization element of the bottom die comprises at least two pins that connect to a press to maintain the bottom die in a fixed position when the press is in use.

12. The die of claim 9, wherein the bottom die further comprises a central annular ridge surrounded by a planar surface.

13. The die of claim 12, wherein the central annular ridge comprises a converging outer side wall, wherein the side wall's diameter at a base of the side wall is greater than the side wall's diameter at a top of the side wall, and wherein the central annular ridge defines the bore centrally located in a top surface of the bottom die.

14. The die of claim 9, wherein the stabilization element of the top die comprises a threaded pin that connects to a press to maintain the top die in a fixed position when the press is in use.

15. The die of claim 9, wherein a side surface of the top die comprises a first sight line and a side surface of the bottom die comprises a second sight line, wherein the sight lines of the top and bottom dies are positionable to align the top and bottom dies when they are connected to the press.

16. The die of claim 9, wherein the side wall of the bottom die is flat or concavely curved as it converges from the larger diameter of the side wall's base to the small diameter of the side wall's top.

17. A system for attaching a washer to a grommet, wherein the combined grommet-washer assembly is for use with a system for opening and closing window treatments, the system for attaching the grommet to the washer comprising:

a top die for pressing a washer onto a grommet, the top die comprising a stabilization element and a round shaping element attached on a planar surface of the top die, wherein the round shaping element comprises a top wall and a side wall, and wherein the round shaping element further comprises a cut-out that extends through the top wall and the side wall and terminates at the planar surface of the top die;

a bottom die for receiving the grommet for attachment of the washer thereto, the bottom die comprising a stabilization element and a central annular ridge surrounded by a planar surface, wherein the central annular ridge comprises a converging outer side wall, wherein the side wall's diameter at a base of the side wall is greater than the side wall's diameter at a top of the side wall, wherein the central annular ridge defines a bore centrally located in a top surface of the top die, and wherein the round shaping element of the top die is receivable into the bore of the bottom die; and a press on which the top die and the bottom die are installed so that a combined grommet-washer assembly is creatable when the press is actuated to attach the washer to the grommet.

18. The system of claim 17, wherein a side surface of the top die comprises a first sight line and a side surface of the bottom die comprises a second sight line, wherein the sight lines of the top and bottom dies are positionable to align the top and bottom dies when they are connected to the press.

19. The system of claim 17, wherein the side wall of the bottom die is flat or concavely curved as it converges from the larger diameter of the side wall's base to the small diameter of the side wall's top.

20. The system of claim 17, wherein the washer comprises teeth that are pressed into the grommet when the press is actuated.

21. A method for attaching a washer to a grommet, wherein the combined grommet-washer assembly is for use with a system for opening and closing window treatments, the method comprising the steps of:

(a) connecting a top die to a press, wherein the top die is for pressing a washer onto a grommet, and wherein the top die comprises:
  (i) a stabilization element; and
  (ii) a round shaping element attached on a planar surface of the top die, wherein the round shaping element comprises a top wall and a side wall, and wherein the round shaping element further comprises a cut-out that extends through the top wall and the side wall and terminates at the planar surface of the top die;

(b) connecting a bottom die to the press, wherein the bottom die is for receiving the grommet for attachment of the washer thereto, and wherein the bottom die comprises:
  (i) a stabilization element; and
  (ii) a central annular ridge surrounded by a planar surface, wherein the central annular ridge comprises a converging outer side wall, wherein the side wall's diameter at a base of the side wall is greater than the side wall's diameter at a top of the side wall, wherein the central annular ridge defines a bore centrally located in a top surface of the top die, and wherein the round shaping element of the top die is receivable into the bore of the bottom die;

(c) placing the grommet onto the planar surface of the bottom die and the washer on top of the grommet; and (d) actuating the press to press the top die and the bottom die together thereby attaching the waster to the grommet.

* * * * *